US007549405B2

(12) United States Patent
Strandburg et al.

(10) Patent No.: US 7,549,405 B2
(45) Date of Patent: Jun. 23, 2009

(54) OIL FILTER HAVING AN INTEGRAL METERING ORIFICE FOR A VALVE LIFTER OIL MANIFOLD ASSEMBLY

(75) Inventors: Alan G. Strandburg, Rochester, NY (US); Dominic Borraccia, Spencerport, NY (US); Michael J. Dinkel, Penfield, NY (US)

(73) Assignee: Delphi Technologies, Inc., Troy, MI (US)

( * ) Notice: Subject to any disclaimer, the term of this patent is extended or adjusted under 35 U.S.C. 154(b) by 115 days.

(21) Appl. No.: 11/895,443

(22) Filed: Aug. 24, 2007

(65) Prior Publication Data

US 2009/0050102 A1 Feb. 26, 2009

(51) Int. Cl.
*F01M 11/03* (2006.01)

(52) U.S. Cl. ..... 123/196 A; 123/90.12

(58) Field of Classification Search ..... 123/196 A, 123/196 S, 196 M, 198 E, 90.12
See application file for complete search history.

(56) References Cited

U.S. PATENT DOCUMENTS

| | | | | |
|---|---|---|---|---|
| 3,267,918 | A * | 8/1966 | Ayres | 123/90.35 |
| 3,913,538 | A * | 10/1975 | Ableitner et al. | 123/90.46 |
| 5,666,915 | A * | 9/1997 | Kawashima et al. | 123/196 R |
| 6,439,186 | B1 * | 8/2002 | Owen et al. | 123/90.55 |
| 6,484,680 | B2 * | 11/2002 | Lunsford | 123/90.33 |
| 6,613,220 | B2 * | 9/2003 | Golovatai-Schmidt | 210/130 |
| 2007/0272192 | A1 * | 11/2007 | Sailer et al. | 123/196 A |

* cited by examiner

*Primary Examiner*—Hai H Huynh
(74) *Attorney, Agent, or Firm*—Thomas N. Twomey

(57) ABSTRACT

A combined oil filtration and metering assembly for filtering and metering oil in an oil gallery, such as in a Lifter Oil Manifold Assembly of an internal combustion engine. The filtration and metering assembly includes a filtration element at an oil entrance leading to an internal chamber having a metering orifice as an outlet to a downstream portion of the oil gallery. Preferably the metering orifice has a diverging exit cone. Preferably, the assembly replaces directly a prior art metering valve in a LOMA socket without requiring retooling of the LOMA top plate. The assembly may be readily formed by molding of the filtration element into the oil entrance in an injection overmolding process.

11 Claims, 3 Drawing Sheets

OIL FILTER HAVING AN INTEGRAL METERING ORIFICE FOR A VALVE LIFTER OIL MANIFOLD ASSEMBLY

TECHNICAL FIELD

The present invention relates to oil filtration and metering in an internal combustion engine; more particularly, to a mechanism for filtering and metering oil being supplied to valve lifting and/or variable valve actuation mechanisms; and most particularly, to a metering orifice unit having an integral oil filtration element downstream of the primary filter element.

BACKGROUND OF THE INVENTION

Internal combustion engines require distribution of lubricating oil to various components having hydraulic or lubricating requirements, such as bearings, bushings, tappets, camshaft phasers, lash adjusters, variable valve actuation devices, and hydraulic lifters. Engine lubricating oil typically resides in a sump and is pumped to the various components via an intricate system of oil galleries, from whence the oil is returned to the sump by gravity after use. Because the oil flow is split many times in satisfying the galleries, flow restrictions are known to be provided at various locations to cause various levels of backpressures and flow equalizations. These restrictions, which may be as small as 0.5 mm in diameter, or even smaller, are vulnerable to plugging by any contaminating particles carried by the oil which, once restricted or blocked, can present difficulty in purging air from the oil galleries.

Engine oil is dirtied in use by exhaust gas blowby from the cylinders and by frictional degradation, so a typical engine is provided with a global filtration system, either flow-through or bypass, that continuously filters oil during engine operation. Despite this filtration system, particulates are known to enter the oil galleries and foul the metering orifices. Hence, in a known Lifter Oil Manifold Assembly (LOMA), a regional filter is provided at the gallery entrance to the LOMA to screen out particulates from the lifter oil. Further, within the LOMA, up to four press-in-place metering valves are provided to act as flow limiters for gallery oil. These valves each contain a converging/diverging venturi orifice to create a homogeneous oil flow stream that constantly purges air from the control circuit (air is known to be drawn into the oil system under some engine operating and shutdown conditions).

In the prior art, the metering valves are formed of die-cast zinc and contain no filtration protection of their own. A two-stage manufacturing process is used to produce the valves in which the part is first cast and then the metering orifice is punched, or fabricated in some way, radially through the center of the valve. Manufacturing tolerances on the metering orifice as well as on the top plate that retains the valves in the LOMA are necessarily demanding, and therefore expensive to maintain, to prevent oil leakage around and retain the metering valves. Further, a shelf is cast into each of the supply channels of the top plate as a compression limiter to prevent the metering valve from creeping when assembled in place and during subsequent thermal cycling in the part application. Again, all tolerances are demanding. Further, the manufacturing process for the individual zinc-cast valves is relatively expensive.

What is needed in the art is an oil filtration assembly having an integral metering orifice downstream of the filter element, preferably wherein the assembly can replaceably substitute for a prior art cast metering valve.

It is a principal object of the present invention to improve reliability and ease of oil metering and air purging in a LOMA by providing immediate filtration protection of said valves.

SUMMARY OF THE INVENTION

Briefly described, an oil filtration and metering assembly in accordance with the invention for filtering and metering oil in an oil gallery, such as a LOMA, of an internal combustion engine includes a filtration element at an assembly entrance leading to an internal chamber having a metering orifice as an outlet to a downstream portion of the oil gallery. Preferably the metering orifice has a diverging exit cone. Preferably, the assembly replaces directly a prior art metering valve without requiring retooling of the LOMA oil gallery.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
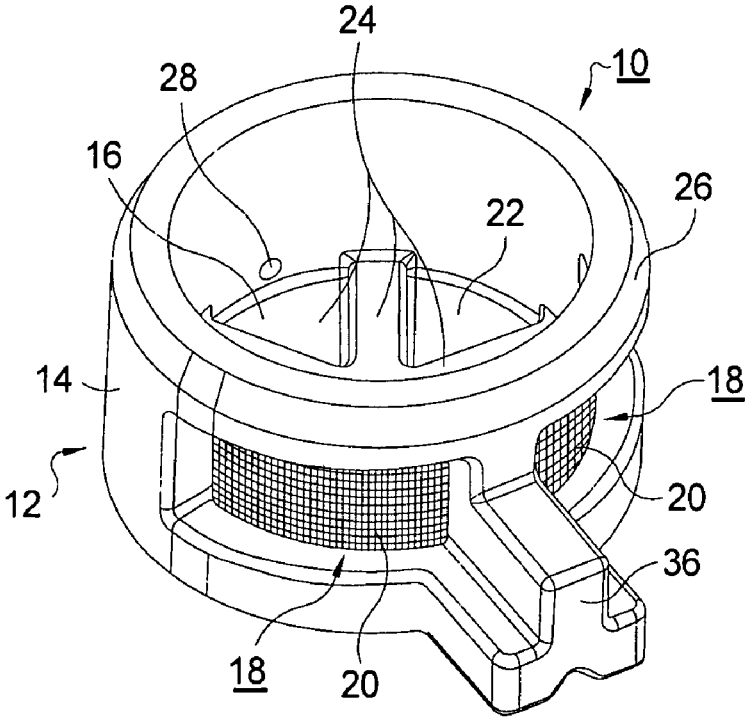
FIG. 1 is a first isometric view of an oil filtration and metering assembly in accordance with the invention.
Figure 2:
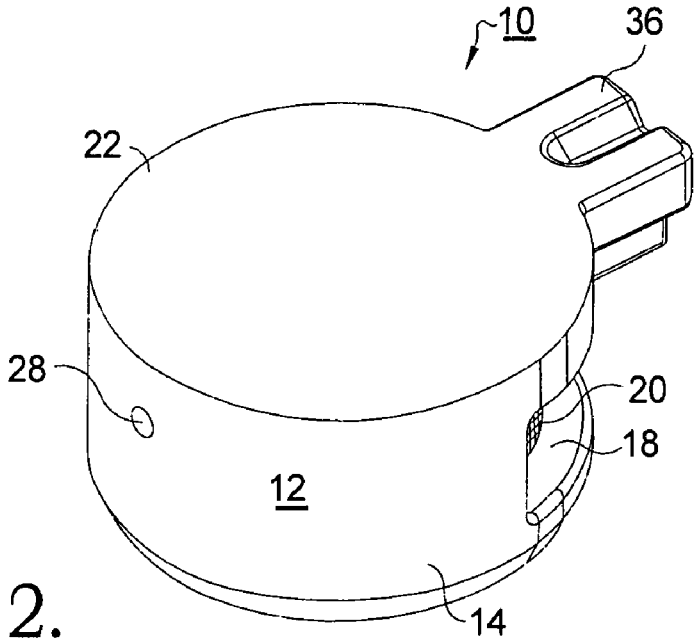
FIG. 2 is a second and obverse isometric view of an oil filtration and metering assembly in accordance with the invention.
Figure 3:
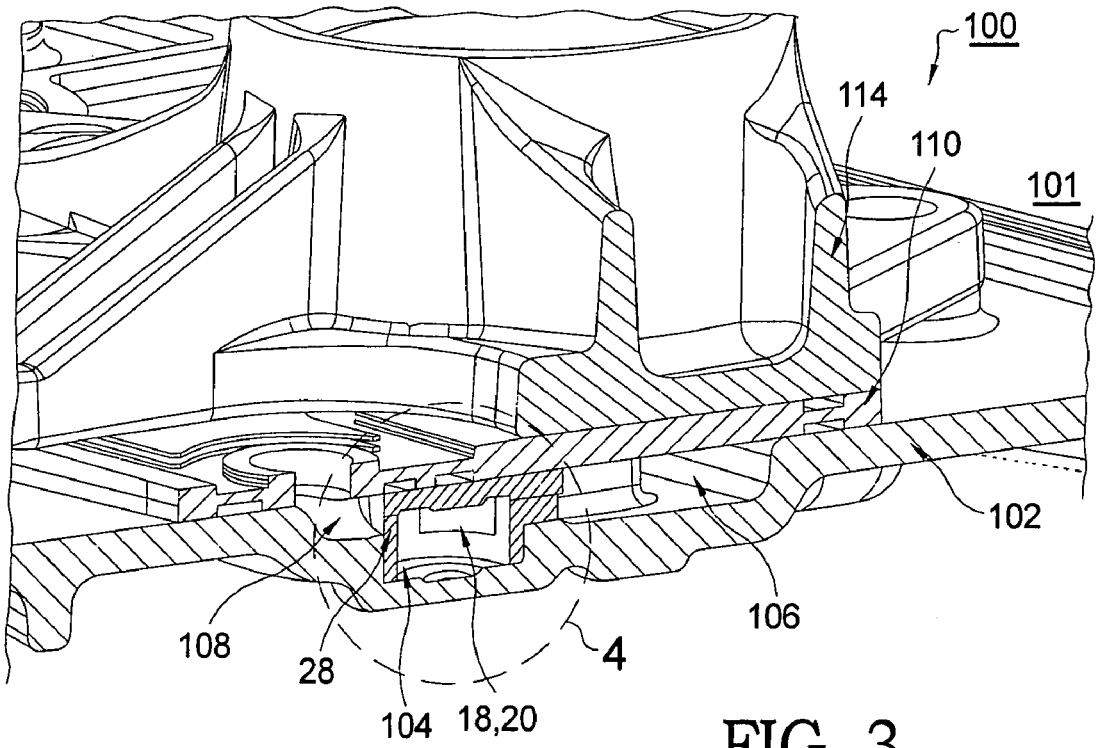
FIG. 3 is a first cross-sectioned isometric view of a LOMA containing an oil filtration and metering assembly in accordance with the invention.
Figure 4:
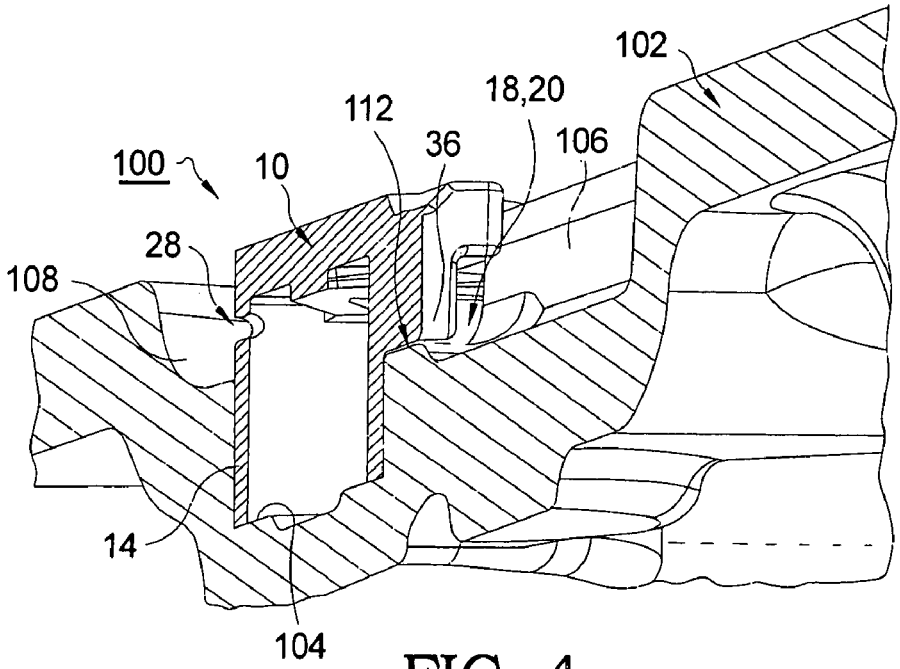
FIG. 4 is a second cross-sectioned isometric view of a LOMA containing an oil filtration and metering assembly taken within Circle 4 in FIG. 3.
Figure 5:
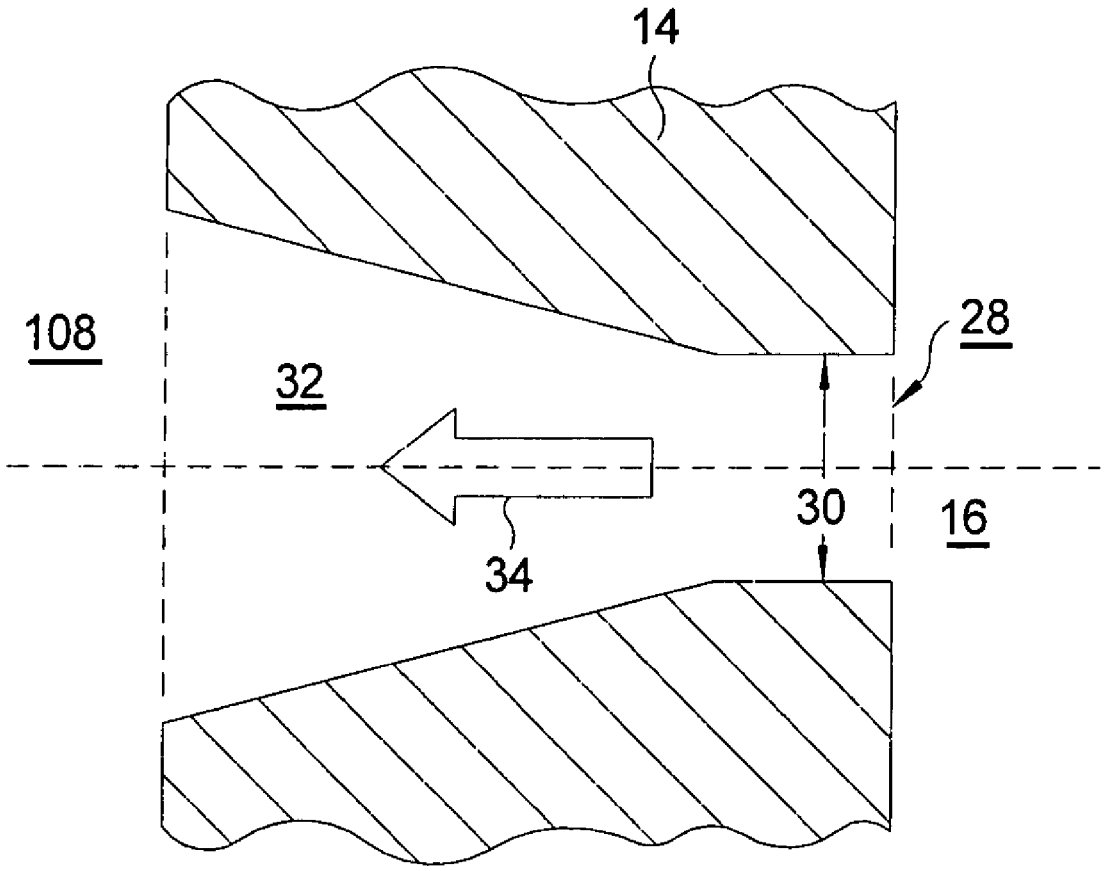
FIG. 5 is an elevational cross-sectional view taken through a metering orifice in a wall of an oil filtration and metering assembly in accordance with the invention.

Referring to FIGS. 1 and 2, a combined oil filtration and metering assembly 10 in accordance with the invention comprises a hollow body 12 having an outer wall defining an internal chamber and having an opening in the outer wall. Preferably, a cylindrical wall 14 encloses a chamber 16 and has one or more openings 18 for supporting a filter mesh element 20 for filtering particles from oil passing from outside assembly 10 through openings 18 into chamber 16. Cylindrical wall 14 is closed at a first axial end by an end 22 which preferably is reinforced by radial ribs 24 and preferably has a smooth outer surface as shown in FIG. 2; wall 14 is open at a second axial end and terminates preferably in a chamfer 26 to facilitate insertion of assembly 10 into a female socket during assembly of an engine, as shown in FIGS. 3 and 4. A metering orifice 28 is formed in wall 14 for exit of filtered oil from chamber 16 at a predetermined flow rate. Referring to FIG. 5, orifice 28 preferably has a minimum diameter 30 of about 0.5 millimeter and preferably terminates in an exit cone region 32 that diverges in the direction 34 of oil flow. Referring again to FIGS. 1 and 2, a press limiter 36 extends from the outer surface of cylindrical wall 14 that assists in establishing and maintaining a position of assembly 10 within an oil distribution system, as described below.

In a preferred process for forming an exemplary combined oil filtration and metering assembly 10, filter mesh element 20 is positioned in an injection mold and the remainder of the assembly is formed by overmolding a thermoplastic material around filter mesh element 20. Element 20 is thus firmly embedded within wall 14. Preferably, the injection mold is also designed to form metering orifice 28 via a core pin in the same injection-molding process. While the embodiment of FIGS. 1 and 2 shows the mesh element embedded within the wall of hollow body 12, it is understood that the mesh element may be disposed anywhere in the body for filtering oil flow, including within end 22.

Referring now to FIGS. 3 and 4, an exemplary application of a combined oil filtration and metering assembly 10 is shown as a component of a LOMA 100 for a hydraulic valve lifter (not shown) in an internal combustion engine 101. A top plate 102 includes a formed socket 104 for receiving assembly 10 (in substantially the "inverted" orientation shown in FIG. 2). The open end of wall 14 is sealed against the bottom of socket 104. Top plate 102 further includes an oil supply channel 106 upstream of assembly 10 and an oil control passage 108 downstream thereof. Supply channel 106 and control channel 108 are both completed by a gasket 110 that also serves to retain assembly 10 within socket 104. A bench 112 formed in top plate 102 serves as a positioning stop for press limiter 36 to avoid over-compression of assembly 10 during assembly and use of the LOMA which might otherwise result in leakage around the assembly. Supply channel 106 terminates at openings 18 and filter mesh element 20. Similarly, metering orifice 28 discharges into control channel 108. A valve plate 114 compresses and secures gasket 110 against top plate 102 and assembly 10.

Assembly of LOMA 100 consists in press fitting assembly 10 into socket 104 until press limiter 36 engages bench 112. Gasket 110 is installed over assembly 10 and top plate 102, and valve plate 114 is then secured to top plate 102 by fasteners such as, for example, bolts (not shown).

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A combined oil filtration and metering assembly for filtering and metering oil flowing through an oil gallery of an internal combustion engine, comprising:

a) a hollow body having an outer wall defining an internal chamber and having an opening;

b) a filter mesh element disposed in the opening of said body for filtering particles from oil passing through said oil gallery into said chamber; and c) a metering orifice formed in said body for exit of filtered oil from said chamber at a predetermined flow rate into said oil gallery.

2. An assembly in accordance with claim 1 wherein said metering orifice has a minimum diameter of about 0.5 millimeter.

3. An assembly in accordance with claim 1 wherein said metering orifice terminates in an exit cone region that diverges in the direction of oil flow.

4. An assembly in accordance with claim 1 wherein said body is formed of a molded plastic.

5. An assembly in accordance with claim 4 wherein said body is formed by injection molding of said molded plastic.

6. An assembly in accordance with claim 5 wherein said filter mesh element is included in said opening by overmolding.

7. An assembly in accordance with claim 1 further comprising a press limiter extending from said body for positioning said assembly in said oil gallery.

8. An assembly in accordance with claim 1 wherein said oil gallery is an element of a Lifter Oil Manifold Assembly.

9. An assembly in accordance with claim 1 wherein said body includes a cylindrical wall.

10. An assembly in accordance with claim 1 wherein the opening of said body is disposed in said outer wall.

11. An internal combustion engine comprising a Lifter Oil Manifold Assembly, wherein said Lifter Oil Manifold Assembly includes a combined oil filtration and metering assembly for filtering and metering oil, and wherein said combined oil filtration and metering assembly includes a hollow body having an outer wall defining an internal chamber and having an opening, a filter mesh element disposed in the opening of said body for filtering particles from oil passing through said Lifter Oil Manifold into said chamber, and a metering orifice formed in said wall for exit of filtered oil from said chamber at a predetermined flow rate into said Lifter Oil Manifold.

* * * * *